US009410447B2

(12) United States Patent
Coffin et al.

(10) Patent No.: US 9,410,447 B2
(45) Date of Patent: Aug. 9, 2016

(54) FORWARD COMPARTMENT SERVICE SYSTEM FOR A GEARED ARCHITECTURE GAS TURBINE ENGINE

(71) Applicant: United Technologies Corporation, Hartford, CT (US)

(72) Inventors: James B. Coffin, Windsor, CT (US); Todd A. Davis, Tolland, CT (US); Enzo DiBenedetto, Kensington, CT (US)

(73) Assignee: United Technologies Corporation, Hartford, CT (US)

( * ) Notice: Subject to any disclaimer, the term of this patent is extended or adjusted under 35 U.S.C. 154(b) by 803 days.

(21) Appl. No.: 13/693,733

(22) Filed: Dec. 4, 2012

(65) Prior Publication Data

US 2014/0030088 A1 Jan. 30, 2014

Related U.S. Application Data

(60) Provisional application No. 61/677,284, filed on Jul. 30, 2012.

(51) Int. Cl.

| | |
|---|---|
| ***F01D 25/00*** | (2006.01) |
| ***F01D 25/16*** | (2006.01) |
| ***F01D 9/06*** | (2006.01) |
| ***F01D 25/18*** | (2006.01) |

(52) U.S. Cl.

CPC ..... *F01D 25/16* (2013.01); *F01D 9/065* (2013.01); *F01D 25/162* (2013.01); *F01D 25/18* (2013.01)

(58) Field of Classification Search

CPC ..... F01D 25/125; F01D 25/18; F01D 25/162; F01D 25/22; F01D 9/065

See application file for complete search history.

(56) References Cited

U.S. PATENT DOCUMENTS

| | | | | |
|---|---|---|---|---|
| 2,875,579 | A * | 3/1959 | Dimitrius et al. | 60/796 |
| 3,110,153 | A * | 11/1963 | House | 60/207 |
| 4,856,273 | A | 8/1989 | Murray | |
| 4,858,426 | A | 8/1989 | Holcomb | |
| 4,917,218 | A | 4/1990 | Murray | |
| 5,080,555 | A | 1/1992 | Kempinger | |
| 5,257,903 | A * | 11/1993 | Allmon et al. | 415/169.1 |
| 5,782,077 | A * | 7/1998 | Porte | 60/782 |
| 7,266,941 | B2 | 9/2007 | Eleftheriou et al. | |
| 7,315,228 | B2 | 1/2008 | Dooley | |
| 7,370,467 | B2 | 5/2008 | Eleftheriou et al. | |
| 7,619,331 | B2 | 11/2009 | Bouiller et al. | |
| 7,721,546 | B2 | 5/2010 | Fish et al. | |
| 7,739,866 | B2 | 6/2010 | Eleftheriou et al. | |
| 7,765,787 | B2 | 8/2010 | Eleftheriou et al. | |
| 7,770,378 | B2 | 8/2010 | Eleftheriou et al. | |
| 7,793,488 | B2 | 9/2010 | Eleftheriou et al. | |
| 7,797,922 | B2 | 9/2010 | Eleftheriou et al. | |
| 7,856,824 | B2 * | 12/2010 | Anderson et al. | 60/728 |

(Continued)

FOREIGN PATENT DOCUMENTS

| | | |
|---|---|---|
| EP | 2103780 A2 | 9/2009 |
| EP | 2538036 A2 | 12/2012 |
| FR | 2896537 A1 | 7/2007 |

OTHER PUBLICATIONS

International search report for PCT/US2013/052723 dated Oct. 25, 2013.

*Primary Examiner* — Ninh H Nguyen

(74) *Attorney, Agent, or Firm* — Bachman & LaPointe, P.C.

(57) ABSTRACT

A gas turbine engine includes a jumper tube that extends through a first passage and a second passage.

18 Claims, 5 Drawing Sheets

(56) References Cited

U.S. PATENT DOCUMENTS

| | | | | |
|---|---|---|---|---|
| 7,856,825 | B2 | 12/2010 | Fish et al. | |
| 7,856,830 | B2 | 12/2010 | Alkabie | |
| 7,862,293 | B2 | 1/2011 | Olver | |
| 8,171,738 | B2 | 5/2012 | Fish et al. | |
| 8,231,142 | B2 * | 7/2012 | Olver | F16L 23/167 285/13 |
| 8,240,974 | B2 | 8/2012 | Nyamu et al. | |
| 8,297,916 | B1 | 10/2012 | McCune | |
| 8,297,917 | B1 | 10/2012 | McCune | |
| 8,371,127 | B2 * | 2/2013 | Durocher et al. | 60/806 |
| 8,834,095 | B2 | 9/2014 | Davis | |
| 2005/0199445 | A1 | 9/2005 | Zalewski et al. | |
| 2009/0110537 | A1 | 4/2009 | Jain | |
| 2010/0275572 | A1 | 11/2010 | Durocher et al. | |
| 2010/0317478 | A1 | 12/2010 | McCune et al. | |
| 2012/0011824 | A1 | 1/2012 | Cigal et al. | |
| 2012/0121378 | A1 | 5/2012 | Sheridan et al. | |

* cited by examiner

FORWARD COMPARTMENT SERVICE SYSTEM FOR A GEARED ARCHITECTURE GAS TURBINE ENGINE

BACKGROUND

The present disclosure claims priority to U.S. Provisional Patent Disclosure Ser. No. 61/677,284, filed Jul. 30, 2012.

The present disclosure relates to a gas turbine engine, and in particular, to a case structure that provides a service pathway around a geared architecture.

Gas turbine engines with geared architectures may utilize epicyclic reduction gearbox for their compact design and efficient high gear reduction capabilities. The reduction gearbox of the geared architecture isolates and de-couples the fan and low spool, which may result in isolation of the forward-most bearing compartment from service pathways.

SUMMARY

A gas turbine engine according to one disclosed non-limiting embodiment of the present disclosure includes a first component that defines a first passage and a jumper tube that extends through the first passage.

In a further embodiment of the foregoing embodiment, the first component is an engine case.

In a further embodiment of any of the foregoing embodiments, the jumper tube extends from a second component. In the alternative or additionally thereto, the foregoing embodiment includes the second component is a bearing support. In the alternative or additionally thereto, the foregoing embodiment includes the first component is a fan inlet case and the second component is a #1/#1.5 bearing support.

In a further embodiment of any of the foregoing embodiments, the jumper tube is resiliently mounted within the first passage.

In a further embodiment of any of the foregoing embodiments, further comprising a flange that mounts the jumper tube to the first component. In the alternative or additionally thereto, the foregoing embodiment includes the flange defines an opening in communication with a bore through the jumper tube.

In a further embodiment of any of the foregoing embodiments, the jumper tube includes a lateral opening. In the alternative or additionally thereto, the foregoing embodiment includes the lateral opening communicates with one of the first component and the second component.

In a further embodiment of any of the foregoing embodiments, the jumper tube communicates with a hollow strut.

A gas turbine engine according to another disclosed non-limiting embodiment of the present disclosure includes a fan inlet case that defines a first passage, the fan inlet case includes a hollow strut, a bearing support that defines a second passage, and a jumper tube that extends through the first passage and the second passage to communicate with the hollow strut.

In a further embodiment of the foregoing embodiment, the jumper tube includes a lateral opening. In the alternative or additionally thereto, the foregoing embodiment includes the lateral opening communicates with the bearing support.

In a further embodiment of any of the foregoing embodiments, further comprising a flange that mounts the jumper tube to one of the first component and the second component. In the alternative or additionally thereto, the foregoing embodiment includes the flange defines an opening in communication with a bore through the jumper tube.

A method of assembling a gas turbine engine, according to another disclosed non-limiting embodiment of the present disclosure includes assembling a first component that defines a first passage to a second component that defines a second passage, and inserting a jumper tube through the first passage and the second passage.

In a further embodiment of the foregoing embodiment, comprising resiliently mounting the jumper tube with a multiple of seals.

In a further embodiment of any of the foregoing embodiments, further comprising providing a service pathway through the jumper tube. In the alternative or additionally thereto, the foregoing embodiment includes directing the service pathway through a lateral opening in the jumper tube.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
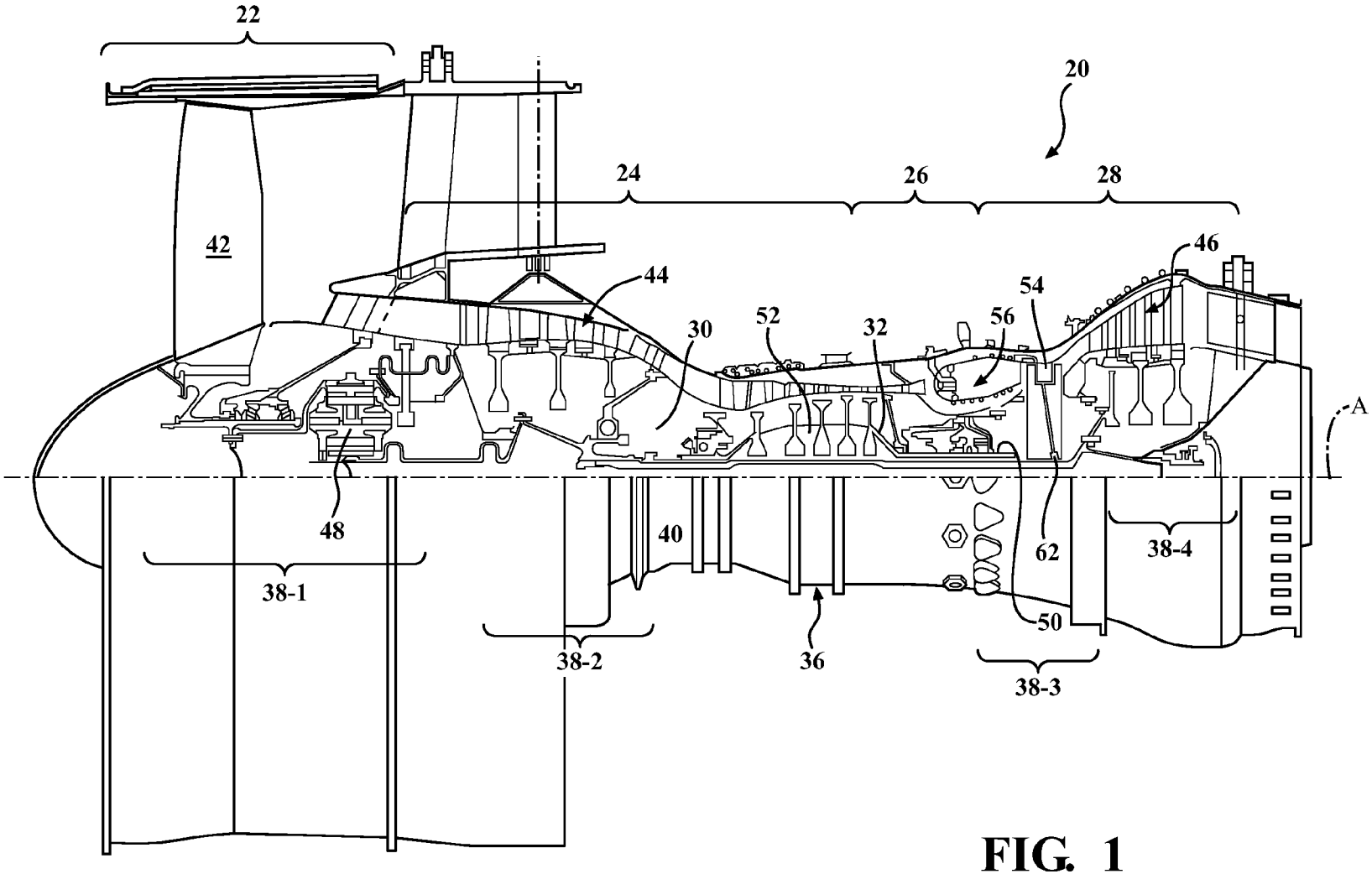
FIG. 1 is a schematic cross-section of a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flowpath while the compressor section 24 drives air along a core flowpath for compression and communication into the combustor section 26 then expansion through the turbine section 28. Although depicted as a turbofan gas turbine engine in the disclosed non-limiting embodiment, it should be understood that the concepts described herein are not limited to use with turbofans as the teachings may be applied to other types of turbine engines such as a three-spool (plus fan) engine wherein an intermediate spool includes an intermediate pressure compressor (IPC) between the LPC and HPC and an intermediate pressure turbine (IPT) between the HPT and LPT.

The engine 20 generally includes a low spool 30 and a high spool 32 mounted for rotation about an engine central longitudinal axis A relative to an engine static structure 36 via several bearing compartments 38-1-38-4. The low spool 30 generally includes an inner shaft 40 that interconnects a fan 42, a low pressure compressor 44 ("LPC") and a low pressure turbine 46 ("LPT"). The inner shaft 40 drives the fan 42 through a geared architecture 48 to drive the fan 42 at a lower speed than the low spool 30. An exemplary reduction transmission is an epicyclic transmission, namely a planetary or star gear system.

The high spool 32 includes an outer shaft 50 that interconnects a high pressure compressor 52 ("HPC") and high pressure turbine 54 ("HPT"). A combustor 56 is arranged between the high pressure compressor 52 and the high pressure turbine 54. The inner shaft 40 and the outer shaft 50 are concentric and rotate about the engine central longitudinal axis A which is collinear with their longitudinal axes.

Core airflow is compressed by the low pressure compressor 44 then the high pressure compressor 52, mixed with the fuel and burned in the combustor 56, then expanded over the high pressure turbine 54 and low pressure turbine 46. The turbines 54, 46 rotationally drive the respective low spool 30 and high spool 32 in response to the expansion.

The main engine shafts 40, 50 are supported within the static structure 36 at a plurality of points by bearing compartments 38-1-38-4. In one non-limiting embodiment, a #1 bearing compartment 38-1 located radially inboard of the fan section 22.

In one non-limiting example, the gas turbine engine 20 is a high-bypass geared aircraft engine. In a further example, the gas turbine engine 20 bypass ratio is greater than about six (6:1). The geared architecture 48 can include an epicyclic gear train, such as a planetary gear system or other gear system. The example epicyclic gear train has a gear reduction ratio of greater than about 2.3, and in another example is greater than about 2.5:1. The geared turbofan enables operation of the low spool 30 at higher speeds which can increase the operational efficiency of the low pressure compressor 44 and low pressure turbine 46 and render increased pressure in a fewer number of stages.

A pressure ratio associated with the low pressure turbine 46 is pressure measured prior to the inlet of the low pressure turbine 46 as related to the pressure at the outlet of the low pressure turbine 46 prior to an exhaust nozzle of the gas turbine engine 20. In one non-limiting embodiment, the bypass ratio of the gas turbine engine 20 is greater than about ten (10:1), the fan diameter is significantly larger than that of the low pressure compressor 44, and the low pressure turbine 46 has a pressure ratio that is greater than about five (5:1). It should be understood, however, that the above parameters are only exemplary of one embodiment of a geared architecture engine and that the present disclosure is applicable to other gas turbine engines including direct drive turbofans.

In one embodiment, a significant amount of thrust is provided by the bypass flow path B due to the high bypass ratio. The fan section 22 of the gas turbine engine 20 is designed for a particular flight condition—typically cruise at about 0.8 Mach and about 35,000 feet. This flight condition, with the gas turbine engine 20 at its best fuel consumption, is also known as bucket cruise Thrust Specific Fuel Consumption (TSFC). TSFC is an industry standard parameter of fuel consumption per unit of thrust.

Fan Pressure Ratio is the pressure ratio across a blade of the fan section 22 without the use of a Fan Exit Guide Vane system. The low Fan Pressure Ratio according to one non-limiting embodiment of the example gas turbine engine 20 is less than 1.45. Low Corrected Fan Tip Speed is the actual fan tip speed divided by an industry standard temperature correction of $(\text{"T"}/518.7)^{0.5}$. in which "T" represents the ambient temperature in degrees Rankine. The Low Corrected Fan Tip Speed according to one non-limiting embodiment of the example gas turbine engine 20 is less than about 1150 fps (351 m/s).

Figure 2:
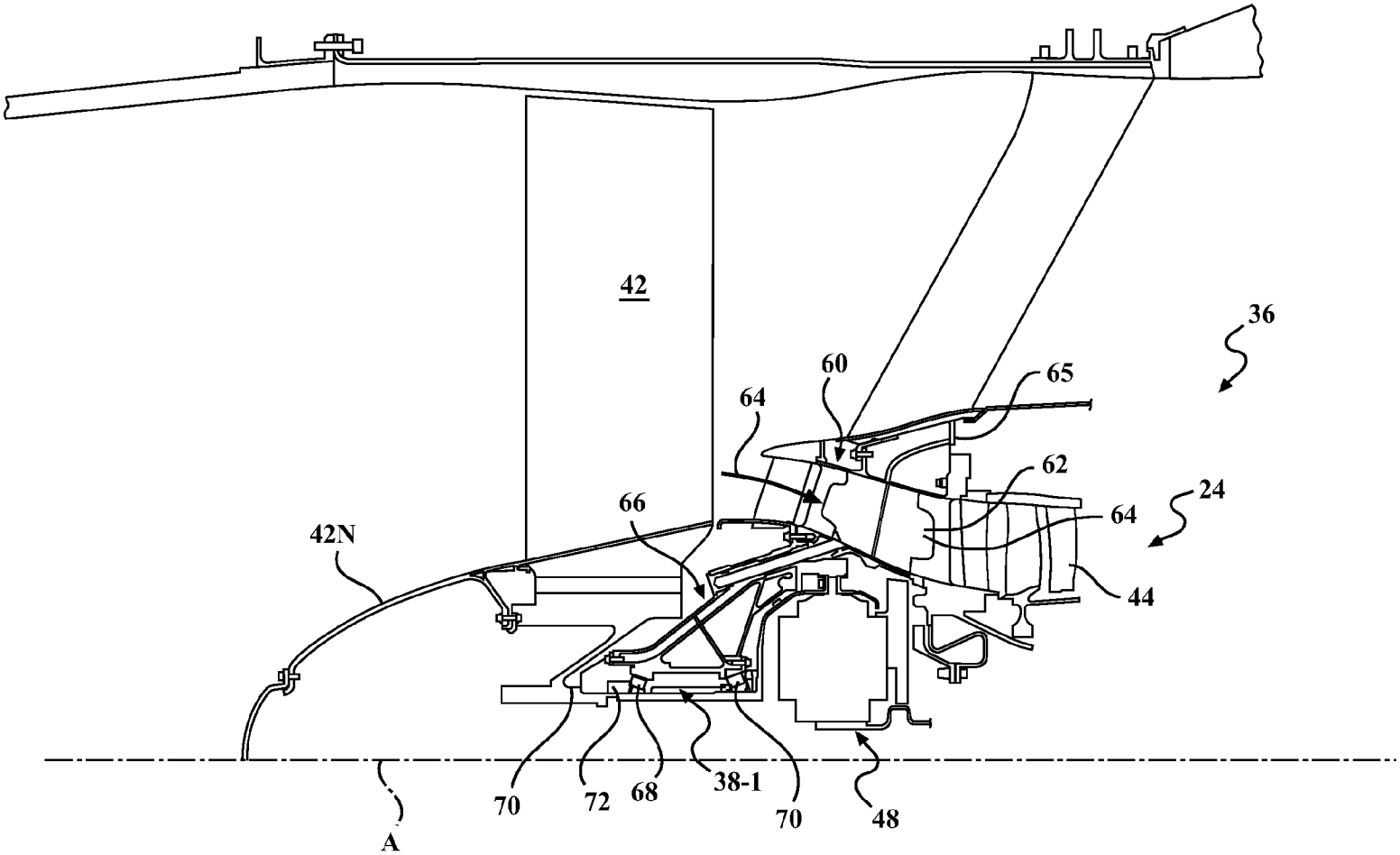
FIG. 2 is an enlarged schematic cross-section of the gas turbine engine.

With reference to FIG. 2, the engine case structure 36 proximate the compressor section 24 generally includes a fan inlet case 60 with a multiple of hollow struts 62. The multiple of hollow fan struts 62 may also be referred to as "wet struts" that provide services pathways across a primary airflow path 64. The services pathways may terminate at a rear bulkhead 65 radially outward of the primary airflow path 64 where services may be readily connected.

The fan inlet case 60 defines the annular primary airflow path 64 to direct core airflow into the LPC 44. The fan inlet case 60 mounts a #1/1.5 bearing support structure 66 therein to define a front bearing compartment 38-1. The frustro-conical shaped #1/1.5 bearing support structure 66 beneficially mounts closely within a frustro-conical fan hub to facilitate a more compact arrangement. It should be appreciated that various case structures may alternatively or additionally be provided, yet benefit from the architecture described herein. The #1/1.5 bearing support structure 66 supports a #1 bearing 68, a #1.5 bearing 70, one or more seals 72 and the geared architecture 48. The #1 bearing 68 and the #1.5 bearing 70 rotationally support rotation of a fan output shaft 74 that connects the LPC 44 with the geared architecture 48 to drive the fan 42. The seals 72 contain oil to define a "wet" front bearing compartment 38-1. For ease of reference, regions or volumes that contain oil may be referred to as a "wet" zone and an oil-free region may be referred to as a "dry" zone. So, for example, the interior of each bearing compartment 38-1 may be referred to as a wet zone that ultimately communicates with an oil sump while the regions external thereto may be referred to as a dry zone.

Figure 3:
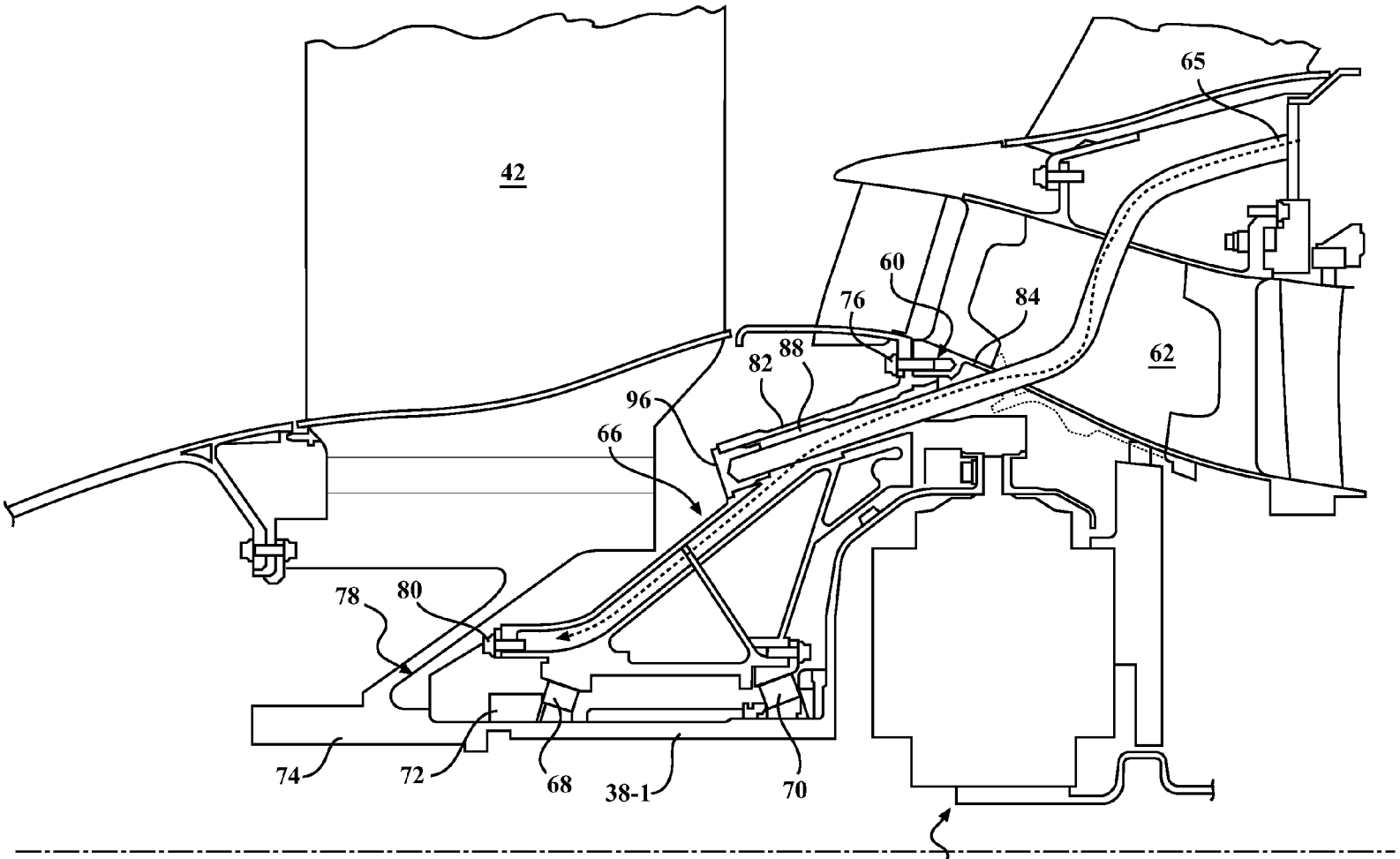
FIG. 3 is an enlarged schematic cross-section of a forward section of the gas turbine engine.

With reference to FIG. 3, the #1/1.5 bearing support structure 66 mounts to the fan inlet case 60 with fasteners 76 and to a #1 seal support 78 with fasteners 80 such as a respective ring of bolts. The #-1/#1.5 bearing support structure 66 and the fan inlet case 60 may be manufactured as cast components with respective passages 82, 84 that are integrally cast therein. The cast passages 82, 84 provide for cooling, lubrication or other service pathways, but, being cast, may not be air or even fluid tight.

Figure 4:
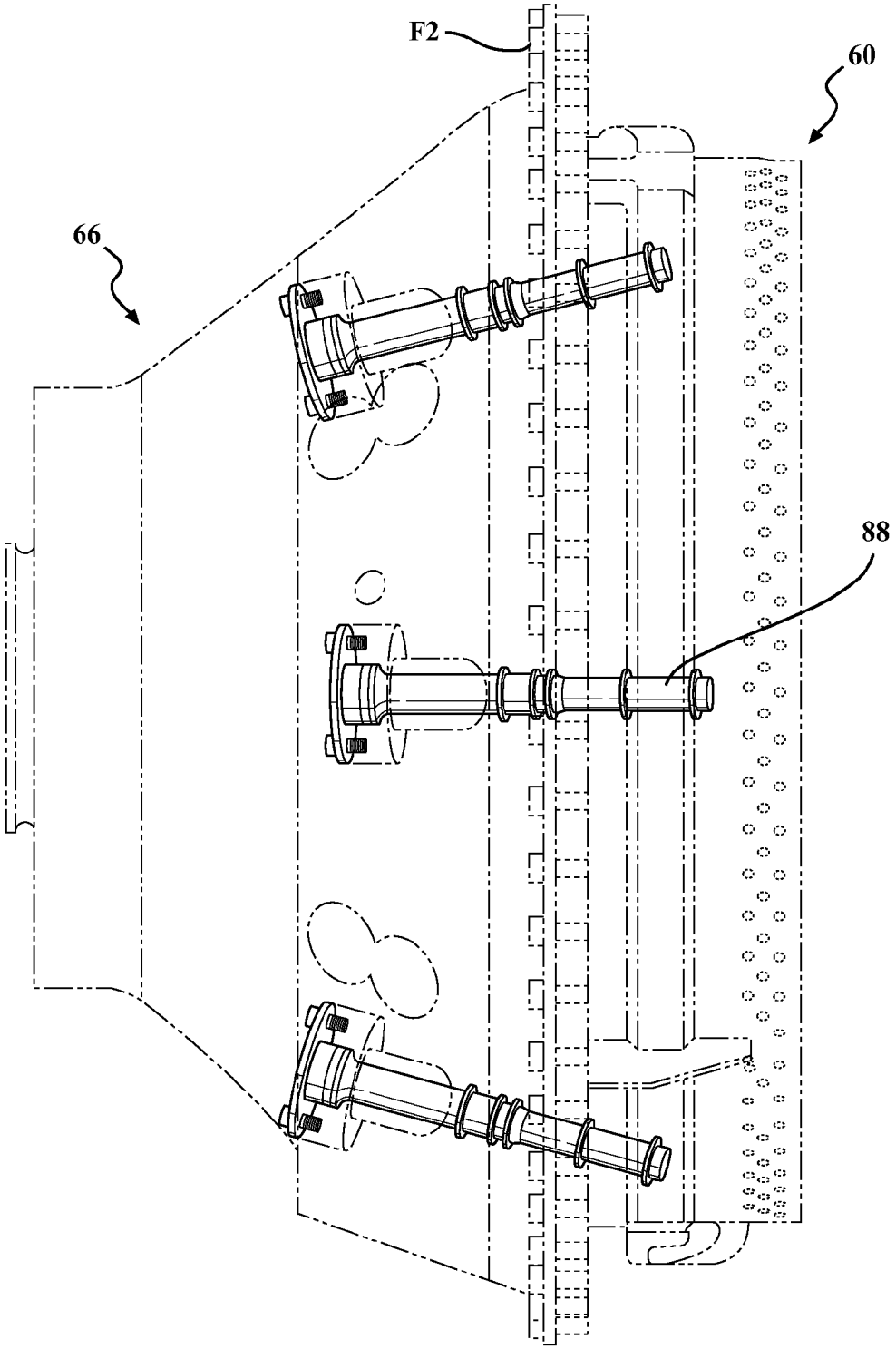
FIG. 4 is a side perspective exploded view of a #1/1.5 bearing support structure with a multiple of jumper tubes mounted therein.

A multiple of jumper tubes 88 are mounted within the #1/1.5 bearing support structure 66 (FIG. 4) to provide a sealed services pathway between the passages 82, 84 across an interface F2 and the hollow struts 62. That is, each jumper tube 88 provides an air or fluid tight services pathway within the the passages 82, 84 across the interface F2 to supply or remove various gaseous or liquid fluids. The jumper tubes 88 may also be utilized to guide wire harnesses or other conduits to and from the relatively remote front bearing compartment 38-1. The jumper tubes 88, although illustrated as independent components in the disclosed non-limiting embodiment, may alternatively be integral to other structure such as the #1/1.5 bearing support structure 66. The jumper tubes 88 may also facilitate "blind" assembly.

Furthermore, the jumper tubes 88 may provide service communication for needs other than the bearing compartment. For example, de-icing air for a fan nosecone 42N may be routed in the same way—but is not used by the bearing compartment.

Figure 5:
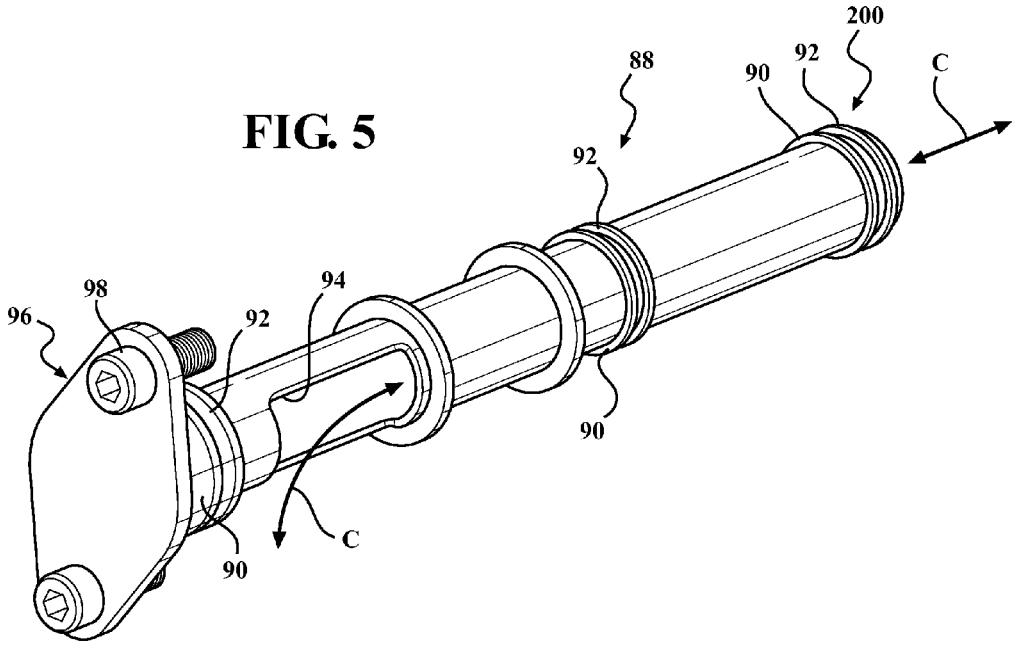
FIG. 5 is a perspective view of a jumper tube according to one disclosed non-limiting embodiment.

With reference to FIG. 5, each jumper tube 88, in one disclosed non-limiting embodiment, includes a multiple of seal grooves 90 each of which may receive a seal 92 such as an O-ring to seal with the passages 82, 84 as well as accommodate relative motion and manufacturing tolerances there between. That is, the interfaces provided by the seals 92 between the jumper tube 88 and the passages 82, 84 are essentially resilient.

A lateral opening 94 through the wall of the jumper tube 88 provides for communication there through (illustrated schematically by arrow C). The jumper tube 88 may have particular applicability, but not be limited to, fluid transfer for communication of, for example, oil "wet" or buffer air "dry".

A flange 96 defines a distal end of the jumper tube 88 to mount the jumper tube 88 to the #1/1.5 bearing support structure 66 with fasteners 98 such as bolts. The flange 96 may include a tab, an oval shape or other shape to receive the fastener 98 generally parallel to the jumper tube 88. The fasteners 98 readily thread and thereby mount the jumper tube 88 into the #1/1.5 bearing support structure 66. It should be appreciated that various fasteners and mount arrangements may alternatively or additionally be provided.

The jumper tube 88 facilitates assembly of the gas turbine engine 20 and formation of sealed services pathways in communication with the forward bearing compartment 38-1. That is, the jumper tube 88 may be assembled after the #1/1.5 bearing support structure 66 and #1 bearing compartment 38-1 are mounted within the fan inlet case 60. The jumper tubes 88 provide a continuous sealed services pathway through a multiple engine components, e.g., the #1/1.5 bearing support structure 66 and the fan inlet case 60 to provide service around the geared architecture 48 to and from the hollow strut 62. The jumper tubes 88 also facilitate the assembly of the geared architecture 48 without resort to "blind assembly".

Figure 6:
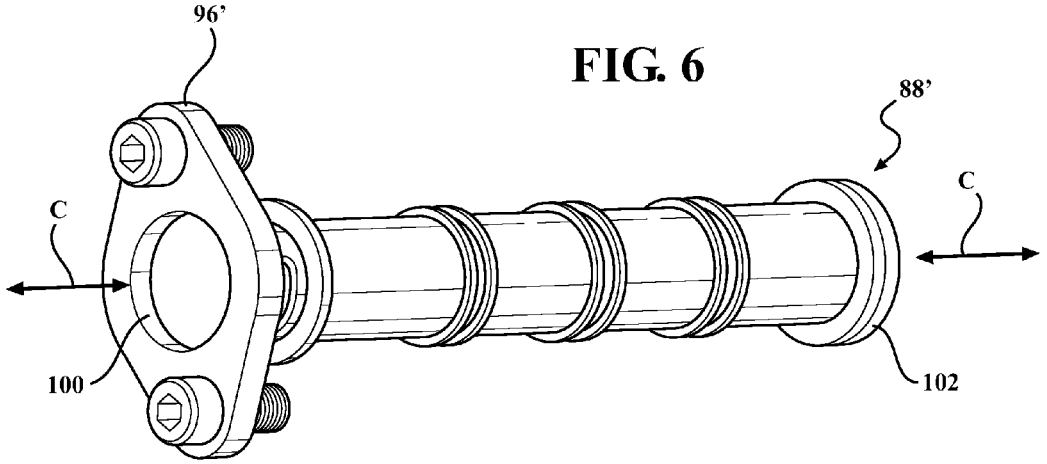
FIG. 6 is a perspective view of a jumper tube according to another disclosed non-limiting embodiment.

With reference to FIG. 6, a jumper tube 88' in another disclosed non-limiting embodiment includes an open distal end 100 through the flange 96' to define an axial services pathway along a through bore 102 defined along a jumper tube axis T'. The jumper tube 88' may have, but not be limited to, particular applicability for conduit, wire harnesses, cable, etc.

It should be understood that like reference numerals identify corresponding or similar elements throughout the several drawings. It should also be understood that although a particular component arrangement is disclosed in the illustrated embodiment, other arrangements will benefit here from.

Although the different examples have specific components shown in the illustrations, embodiments of this invention are not limited to those particular combinations. It is possible to use some of the components or features from one of the examples in combination with features or components from another one of the examples.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the invention may be practiced other than as specifically described. For that reason the appended claims should be studied to determine true scope and content.

What is claimed:

1. A gas turbine engine comprising:

an engine case that defines a first passage; and a jumper tube that extends from a bearing support, the jumper tube mounted to said engine case via a flange such that said jumper tube extends through said first passage.

2. The gas turbine engine as recited in claim 1, wherein said first component is a fan inlet case and said second component is a #1/#1.5 bearing support.

3. The gas turbine engine as recited in claim 1, wherein said first component is a fan inlet case, said jumper tube in communication with a hollow strut of said fan inlet case, said hollow strut providing a services pathway across a primary airflow path.

4. A gas turbine engine comprising:

a first component that defines a first passage; and a jumper tube mounted to said first component via a flange such that said jumper tube extends through said first passage, wherein said jumper tube is resiliently mounted within said first passage via at least one seal.

5. A gas turbine engine comprising:

a first component that defines a first passage; and a jumper tube mounted to said first component via a flange such that said jumper tube extends through said first passage, wherein said flange defines an opening in communication with a bore through said jumper tube.

6. A gas turbine engine comprising:

a first component that defines a first passage; and a jumper tube mounted to said first component via a flange such that said jumper tube extends through said first passage, wherein said jumper tube includes a lateral opening.

7. The gas turbine engine as recited in claim 6, wherein said lateral opening communicates with one of said first component and said second component.

8. A gas turbine engine comprising:

a fan inlet case that defines a first passage, said fan inlet case includes a hollow strut;

a bearing support that defines a second passage;

at jumper tube mounted to said first component via a flange to extend through said first passage and said second passage to communicate with said hollow strut, said hollow strut providing a services pathway across a primary airflow path.

9. The gas turbine engine as recited in claim 8, wherein said jumper tube includes a lateral opening.

10. The gas turbine engine as recited in claim 9, wherein said lateral opening communicates with said bearing support.

11. The gas turbine engine as recited in claim 8, wherein said flange defines an opening in communication with a bore through said jumper tube.

12. The gas turbine engine as recited in claim 8, wherein said flange defines a distal end of the jumper tube.

13. A method of assembling a gas turbine engine comprising:

assembling a first component that defines a first passage to a second component that defines a second passage, said first component and said second component arranged along an engine central longitudinal such that an interface therebetween is transverse to said engine central longitudinal; and inserting a jumper tube through said first passage and said second passage to extend across said interface; and mounting the jumper tube to the first component via a flange, the flange defining a distal end of the jumper tube.

14. The method as recited in claim 13, further comprising resiliently mounting the jumper tube with a multiple of seals within the first passage and the second passage.

15. The method as recited in claim 13, further comprising providing a service pathway through the jumper tube.

16. The method as recited in claim 15, further comprising directing the service pathway through a lateral opening in the jumper tube.

17. A gas turbine engine comprising:

a fan inlet case that defines a first passage;

a #1/#1.5 bearing support that defines a second passage; and at jumper tube that extends through said first passage and said second passge.

18. A gas turbine engine comprising:

a first component that defines a first passage; and a jumper tube mounted to said first component via a flange such that said jumper tube extends through said first passage, wherein said flange defines a distal end of the jumper tube.

* * * * *